US005751109A

United States Patent [19]

Payne

[11] Patent Number: 5,751,109

[45] Date of Patent: May 12, 1998

[54] SEGMENTED COLD CATHODE DISPLAY PANEL

[75] Inventor: Leslie Payne, Annapolis, Md.

[73] Assignee: United States of America as represented by the Administrator, National Aeronautics and Space Administration, Washington, D.C.

[21] Appl. No.: 687,068

[22] Filed: Jul. 8, 1996

[51] Int. Cl.[6] ..... H01J 40/18

[52] U.S. Cl. ..... 313/542

[58] Field of Search ..... 313/422, 542, 313/543, 544, 103 IM, 105 IM, 537, 292; 250/207

[56] References Cited

U.S. PATENT DOCUMENTS

| | | | |
|---|---|---|---|
| 2,258,294 | 10/1941 | Lubszynski et al. | 313/543 X |
| 3,254,253 | 5/1966 | Davis et al. | 313/544 X |
| 4,563,614 | 1/1986 | Howorth | 313/542 X |
| 4,661,694 | 4/1987 | Corcoran | 313/542 X |
| 5,013,902 | 5/1991 | Allard | 313/542 X |

*Primary Examiner*—Ashok Patel
*Attorney, Agent, or Firm*—Keith L. Dixon

[57] ABSTRACT

The present invention is a video display device that utilizes the novel concept of generating an electronically controlled pattern of electron emission at the output of a segmented photocathode. This pattern of electron emission is amplified via a channel plate. The result is that an intense electronic image can be accelerated toward a phosphor thus creating a bright video image. This novel arrangement allows for one to provide a full color flat video display capable of implementation in large formats. In an alternate arrangement, the present invention is provided without the channel plate and a porous conducting surface is provided instead. In this alternate arrangement, the brightness of the image is reduced but the cost of the overall device is significantly lowered because fabrication complexity is significantly decreased.

11 Claims, 6 Drawing Sheets

SEGMENTED COLD CATHODE DISPLAY PANEL

ORIGIN OF THE INVENTION

The invention described herein was made by an employee of the United States Government, and may be manufactured and used by or for the Government for governmental purposes without the payment of any royalty thereon or therefor.

1. Technical Field

The present invention relates to large-format video display panels and more particularly to video display panels employing cold cathodes.

2. Background Art

Several emerging technologies, primary among them the high definition television (HDTV, or Hi-Vision, in Japan) initiative and the "home theater" concept, as well as more specialized applications such as flight simulation, have generated demand for high-quality large-area video displays, especially at consumer product pricing levels. Features desirable for these applications include high contrast, wide video angle, sunlight readability, color quality, and long operating lifetime. It is further desirable to provide these attributes in a package that is thin, flat, low volume, rugged, lightweight, and requires minimal electric power.

While cathode ray tubes (CRTs) have been the traditional technology for converting electrical signals into visual imagery, the fact that the image is written with a beam of electrons emanating from a single electron gun source and steered in a raster scan by intermediary deflection requires significant size in the depth dimension, orthogonal to the plane of the display. This configuration, in conjunction with the envelope area which must withstand atmospheric pressure against an internal vacuum, causes large CRTs to be heavy and cumbersome and impractical commercially above the current maximum 50-inch diagonal measure.

Responding to this demand has been challenging for a number of reasons. Flat panel technologies which serve for smaller displays, such as active matrix liquid crystal technology, are inadequate for larger formats because of the limited luminance they can provide which make them impractical for displays which are to be viewed at any but the closest distances. Plasma display panels and vacuum fluorescent displays are deficient in color capability.

One prior art approach to reducing the depth required to accommodate a steered electron beam has been to employ multiple electron beam sources and to fold the beams. The current invention provides a less complex solution which does not require a multiplicity of deflector plates. Areal electron emission employing the field emission cold cathode principle gives rise to the prior art field emission display (FED). The Difficulty with FED technology is that it does not scale up easily. It is based on lithographic techniques used for fabricating microcircuits. It is difficult to mass-produce display panels with no defects when the display is as large as proposes in this invention.

The use of microchannel plates with suitable voltage potentials applied across them to intensify an image, which has been converted to electrons at a photocathode, is a technology applied in proximity focus image intensifier tubes (PFCIIT), infrared viewers, and other applications. In the display application to which the invention is directed, no input video image is available. Instead, the image is available in electronic format, such as in the video encoded signals of a television broadcast.

Thus the invention teaches that, rather than inducing a pattern of electron emission by impressing a video image, an electronically controlled pattern of electron emission may be generated at the output of a segmented photocathode and an orthogonal array of control grids. By amplifying this pattern of electron emission by means of a proximity focussed channel plate coupled with electron acceleration, an intense electronic image can be impressed upon a phosphor thereby creating a bright video image.

STATEMENT OF THE INVENTION

Accordingly it is an object of this invention to provide a new and improved flat panel video display.

A further object of this invention is to provide an improved flat panel video display capable of implementation in large formats.

It is still a further object of this invention to provide an improved flat panel video display which is thin.

It is also an object of this invention to provide an improved flat panel video display which is lightweight.

Another object of this invention is to provide an improved flat panel video display having high luminance.

It is an additional object of this invention to provide an improved flat panel video display having a full color capability.

Yet another object of this invention is to provide an improved flat panel video display which efficiently converts consumed power to optical luminance.

It is still a further object of this invention to provide an improved flat panel video display requiring low voltage control.

It is still a further object of this invention to provide an improved flat panel video display which is of low complexity and low cost.

SUMMARY OF THE INVENTION

The above and other objects of the present invention are achieved by providing a display tube having an evacuated envelope with a substantially flat output faceplate and rear wall which is substantially parallel to the output faceplate, a photocathode composed of parallel segments which lie in a plane parallel to and inside the rear wall, and electron control grids which are oriented in a plane parallel to the cathode but in a direction orthogonal to the cathode segments, so that pixels are defined by jointly addressing a combination of a cathode segment and a control grid. The display tube also contains an areal light source to illuminate the photocathode, and one or more phosphors parallel to and inside the output faceplate, with a phosphor electrode interior to the phosphor, and a channel plate located between the control grid plane and the phosphor electrode, to amplify the flux of electrons which impinge upon the phosphors and generate a video image.

DETAILED DESCRIPTION OF THE INVENTION

Figure 1:
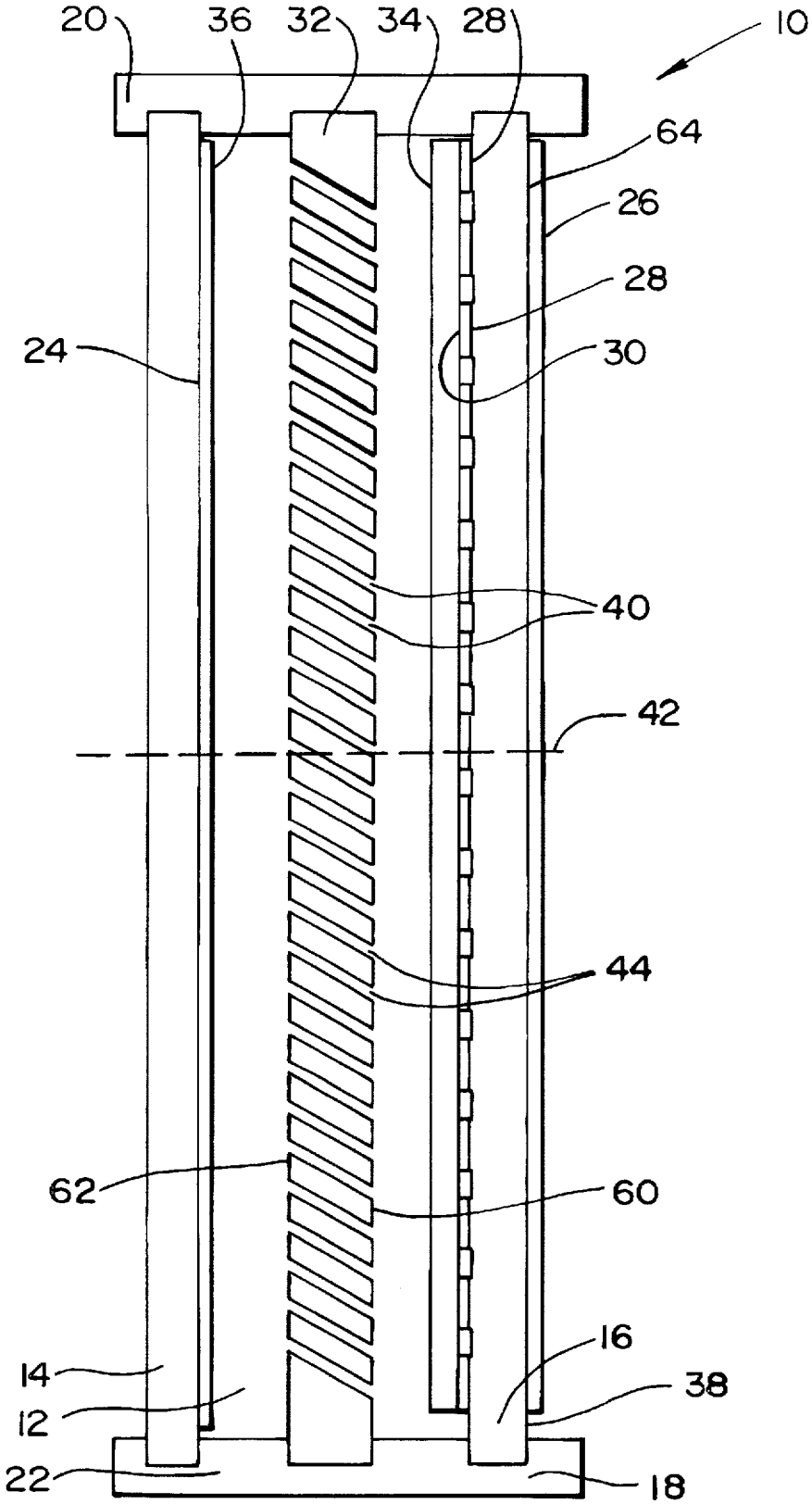
FIG. 1 is a cross sectional view of the invention along a vertical axis.
Figure 2:
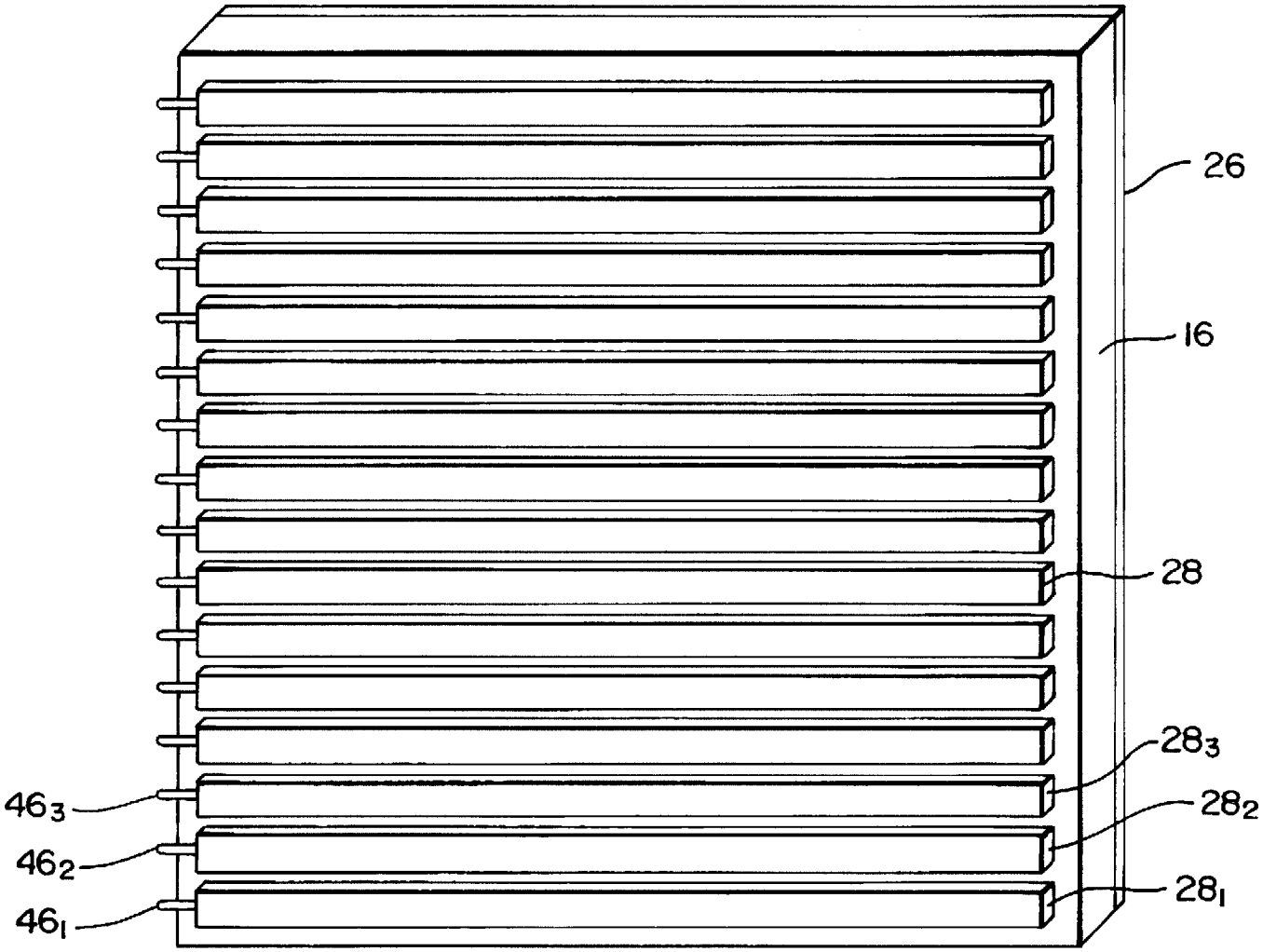
FIG. 2 is a view of the photocathode array looking toward the input window.
Figure 3:
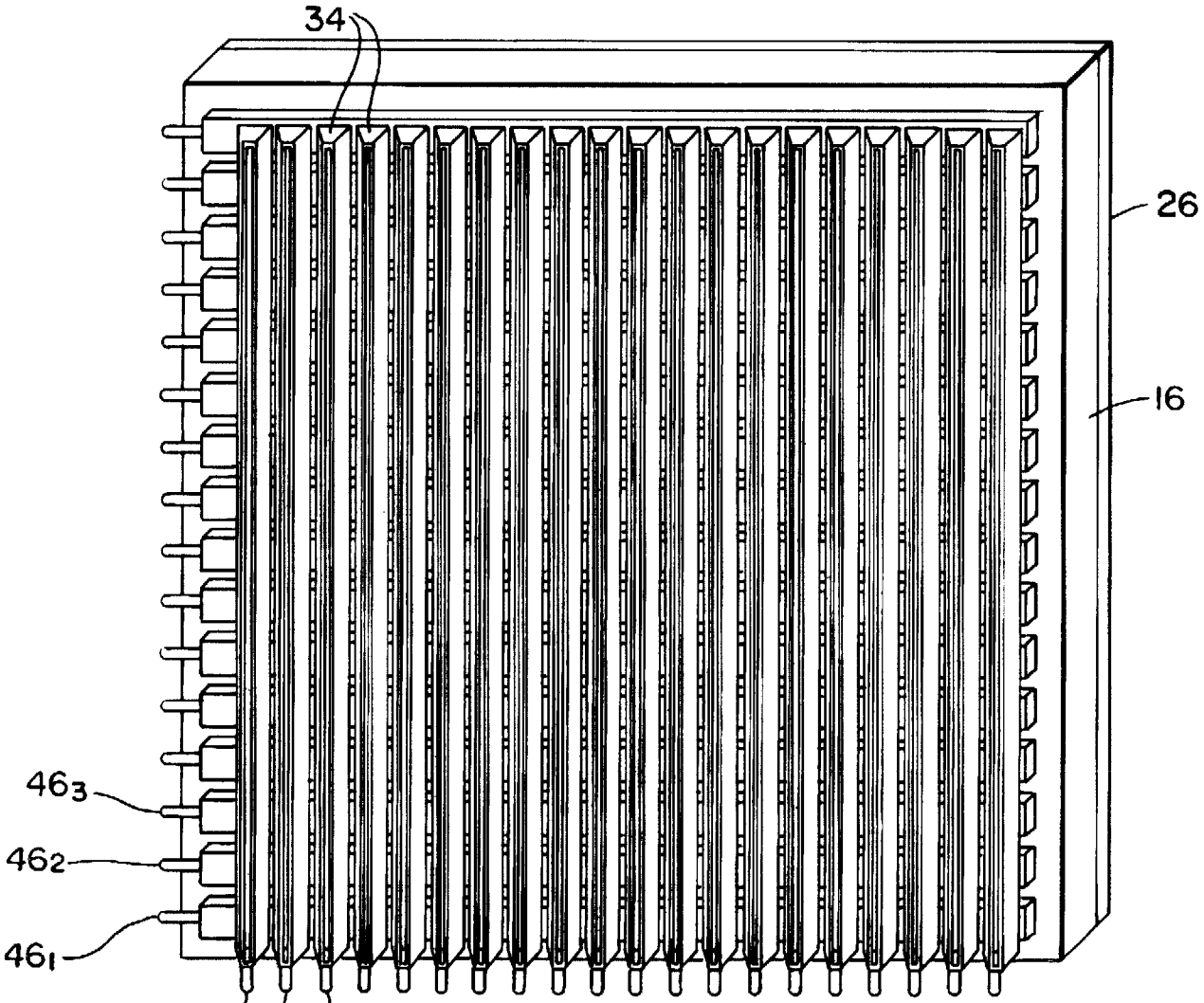
FIG. 3 is a view of the control grid array looking toward the photocathode gate array and input window.

Referring to FIGS. 1 through 3, wherein like reference numerals designate identical or corresponding parts, and more particularly to FIG. 1, a cross sectional view of the preferred embodiment of the invention along a vertical axis is presented. A flat-panel display, generally shown as number 10, has an evacuated vacuum region 12 confined by output faceplate 14, input window 16, and housing 18. Housing 18 encloses vacuum region 12 via housing components 20 and 22 and remaining two sides (not shown). Output faceplate 14 and input window 16 are planar, parallel to each other, and rectangular in shape, and in the preferred embodiment, both are made of glass or other transparent material. Output faceplate 14 and input window 16 have substantially the dimensions of the video image (not shown) which is seen by the viewer (not shown) through output faceplate 14 as the illumination of phosphor 24. The image size is typically at least 50 inches diagonal measure, but may be smaller or even much larger, as dictated by the application. The advantages of the invention are compounded as the size of the image increases.

Referring further to FIG. 1, flat-panel display 10 operates by virtue of electrons 50 (shown in FIG. 4) being emitted from forward-facing surfaces 30 of photocathodes 28, accelerated through control grids 34 toward channel plate 32, where their number is multiplied, and they are further accelerated toward phosphor electrode 36. Electrons 50 pass through phosphor electrode 36 and strike phosphor 24, causing it to glow and to display the intended visual image. As shown in FIG. 2 photocathodes 28 are configured as rectangular segments $28_1$, $28_2$, $28_3$ . . . , each as long as the full width channel plate 32 and as wide as one pixel of the display image, typically I millimeter. Photocathodes 28 are disposed parallel to each other in a plane parallel to input window 16. Referring again to FIG. 1 photocathodes 28 are shown disposed horizontally, by way of example, though their actual orientation is a matter of design choice. Suitable photocathode material includes trialkalis such as $Na_2KSb$:Cs (S-20) or bialkali NaKSb or any transparent photocathode that exhibits visible wavelength sensitivity and is capable of relatively high photocathode current. High photocathode current is augmented by depositing a semi-transparent metallic coating (typically Nikel, Chrome or NiChrome) directly under each photocathode segment. This metallic coating provides the electrical connection for each of the individual photocathode segments. The number of photocathodes 28 represents the number of rows of pixels in the resultant image (not shown) and could typically range from 512 to 1024, while only 16 are shown for illustrative purposes.

Photocathodes 28 emit electrons 50 when suitably illuminated by light of suitable wavelength and when a suitable voltage bias is applied to photocathode 28 with respect to control grids 34 and channel plate 32. In order to provide the light necessary to illuminate photocathodes 28 to stimulate emission of electrons 50, areal light source 26 is disposed substantially parallel to photocathodes 28, and, in the preferred embodiment, is located outside evacuated vacuum region 12 on the exterior side 38 of input window 16. The preferred embodiment, with areal light source 26 located exterior to input window 16 is shown in FIG. 2 as seen from the plane containing forward-facing surfaces 30 of photocathodes 28 looking back toward input window 16 and areal light source 26. Areal light source 26 may be an electroluminescent panel, however other means of distributing uniform illumination over the area of photocathodes 28 will serve the purpose of areal light source 26. For typical visible wavelength photocathodes (ie; S-20), the required light level necessary for photocathode emission is quite low. An electro-luminescent panel with a typical brightness of 0.2 $mw/cm_2$ will provide excessive excitation to the photocathode material. A neutral density filter 64 deposited on the input window will be required to reduce light levels to a level appropriate for operating the photocathode at or near its saturation levels. Excessive light levels will damage the photocathodes.

Referring, again, to FIG. 1, control grids 34 serve to control the flow of electrons 50 from photocathodes 28 where the electrons 50 are emitted, to channel plate 32 where electrons 50 are amplified. Control grids 34 are disposed parallel to each other, and, as a group, are disposed orthogonally to the direction of photocathodes 28. Since photocathodes 28 are shown disposed horizontally by way of example, control grids 34 would be disposed vertically. The number of control grids 34 corresponds, in this case, to the number of columns of pixels in the resultant display image (not shown) and could range from 512 to 2048. Bias voltages are applied between horizontal gate leads $46_1$, $46_2$, $46_3$ . . . (shown in FIG. 2), which are in electrical contact, one-for-one, with photocathodes 28, and vertical gate leads $48_1$, $48_2$, $48_3$ . . . (shown in FIG. 3), which are in electrical contact, one-for-one, with control grids 34. Bias voltages on control grids 34 may be varied continuously between the limits of a complete cut-off of electron flow to allowing all electrons to pass through a particular control grid 34 to channel plate 32. Control grids 34 may be shaped as triangles, as shown in FIG. 3, or may also be single or multiple wires, shaped pieces of metal, or deposited metal film on a substrate (not shown).

Channel plate 32 employs electron multiplying technology well known to the art such as is used in image intensifiers or night viewers. By providing for multiple collisions between electrons 50 and surfaces 44 which emit secondary electrons, gains of $10^2$ to $10^4$ or more in the flux of electrons 50 may be achieved. Surfaces 44 are processed in a manner known to the art which provides a mechanism for secondary electron transmission. Channel plate 32 is a planar glass matrix, of thickness approximately 40 millimeters, containing equally spaced pores 40 for passage of electrons 50 between photocathodes 28 and phosphor electrode 36. Output 62 of channel plate 32 is maintained at a potential of typically 1000 volts with, respect to input 60 of channel plate 32. Pores 40 are arrayed in a matrix with the number of rows equal to the number of photocathodes 26, and the number of columns equal to the number of control grids 34. Each pore 40 corresponds to a pixel of the resultant display image (not shown). The size of the pores 40 determines the relative throughput of electrons 50, while the spacing between the pores 40 determines the resolution of the resultant display image (not shown). It is for pore size in the range of 1 millimeter diameter that the invention provides a great advantage over standard PFCIIT designs, where typical PFCIIT pore sizes are smaller than 0.03 millimeter. Methods of fabricating channel plate 32 are known to the art, and include, as an example, the close-packed stacking of optical fibers and subsequent wet etching of the low-index cores of the optical fibers. Pores 40 of channel plate 32 are oriented at an angle with respect to the normal 42 of channel plate 32, which is also the direction in which electrons 50 are accelerated away from forward-facing surfaces 30 of photocathodes 28, so that successive collisions of electrons 50 with surfaces 44 of pores 40 result in secondary emission and thus multiplication of the number of electrons 50. Other channel plate geometries such as the use of curved pores 40 are known to the art and may be applied in the practice of the invention.

Channel plate 32 is disposed within a distance of approximately ½ to 1 millimeter of control grids 34, a small distance on the scale of the width of the photocathodes 28, the diameter of pores 40, and of pixel size of the display image (not shown). This proximity prevents the spreading of electrons 50 due to their mutual electrostatic repulsion, and auxiliary focusing means are not required. By virtue of this proximity focusing, the invention provides for small thickness of flat-panel display 10 and achieves a large weight advantage over the prior art technologies in which electron beam forming is required. An additional advantage is that low voltages and conventional semiconductor circuits can be used to control the flow of electrons 50.

Figure 6:
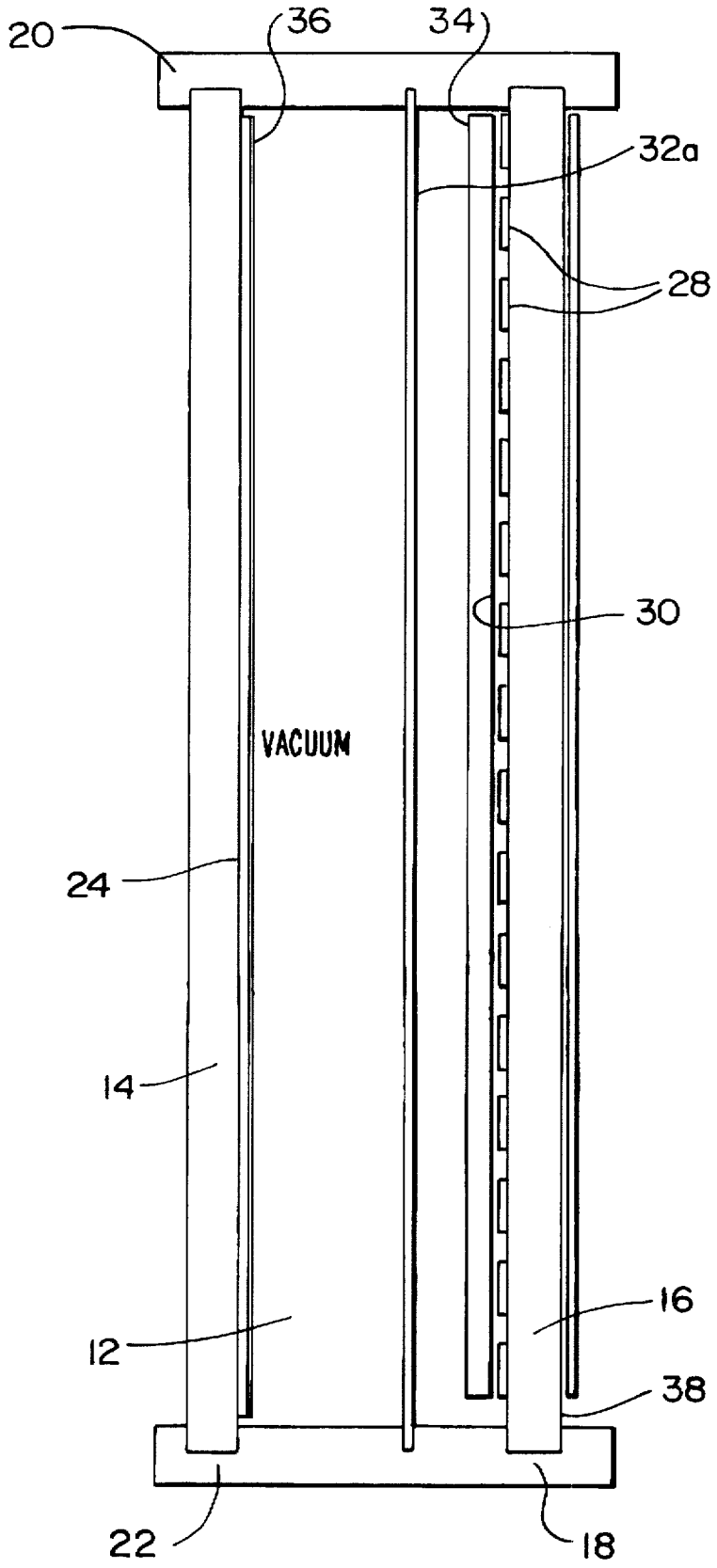
FIG. 6 shows an alternate embodiment of a present invention.

Now referring to FIG. 6, an alternative embodiment of the invention is identical in other respects to the preferred embodiment, except that no channel plate 32 is provided. The channel plate 32 is replaced with a porous conducting surface or plate 32*a* that would be at the same potential as the input surface of the channel plate 32 if it were present. The purpose of this plate is to provide an equipotential plane for the control grids 34 and photocathodes 28 to be referenced against. Conducting surface 32*a* includes a thin plate with holes (not shown) for electron transmission. Conducting surface 32*a* may alternately include a wire mesh surface (not shown). It should be sufficiently porous so as to minimize absorbing electrons emitted by photocathodes 28 as they pass on their way to phosphor 24. Since the absence of channel plate 32 removes the means for multiplying the number of electrons 50 accelerated toward phosphor 24, the brightness of the resultant display is limited to the number of electrons 50 which photocathodes 28 are capable of photo-emitting. While fabrication complexity is greatly reduced by not providing channel plate 32, the low-brightness display will have a more limited application than will the preferred embodiment.

Regarding mechanical support. Smaller tubes can provided their support by pre-stressing the glass envelopes such that after assembly, the inside surface of the glass will change from curved to flat. Larger display tubes will require some form of mechanical support from within the display tube body. Ceramic support structures are preferred since these supports will have approximately 25,000 volts placed across their end points. The size of these supports will be comparable to the size of a single pixel (about 1 mm in diameter). The frequency of placement of these supports is determined by the thickness of the input and output windows. Each support will result in the loss of 1 to 2 pixels on the display screen. The location of the support will be between adjacent control grids and extend between the interior faces of the input and output windows. The control grid structure will be contiguous and uninterrupted by the support structure. The channel plate will have cutouts of appropriate size to accommodate the support structure.

In an alternative embodiment, two or more channel plates 32 may be stacked, parallel to one another, to provide increased amplifications of the number of electrons 50 accelerated toward phosphor 24, thereby enhancing the brightness of the resultant display. Also, the channel plate may be of discrete dynode manufacture, vs. the gl. s based channel plate as described in the preferred embodiment.

Figure 4:
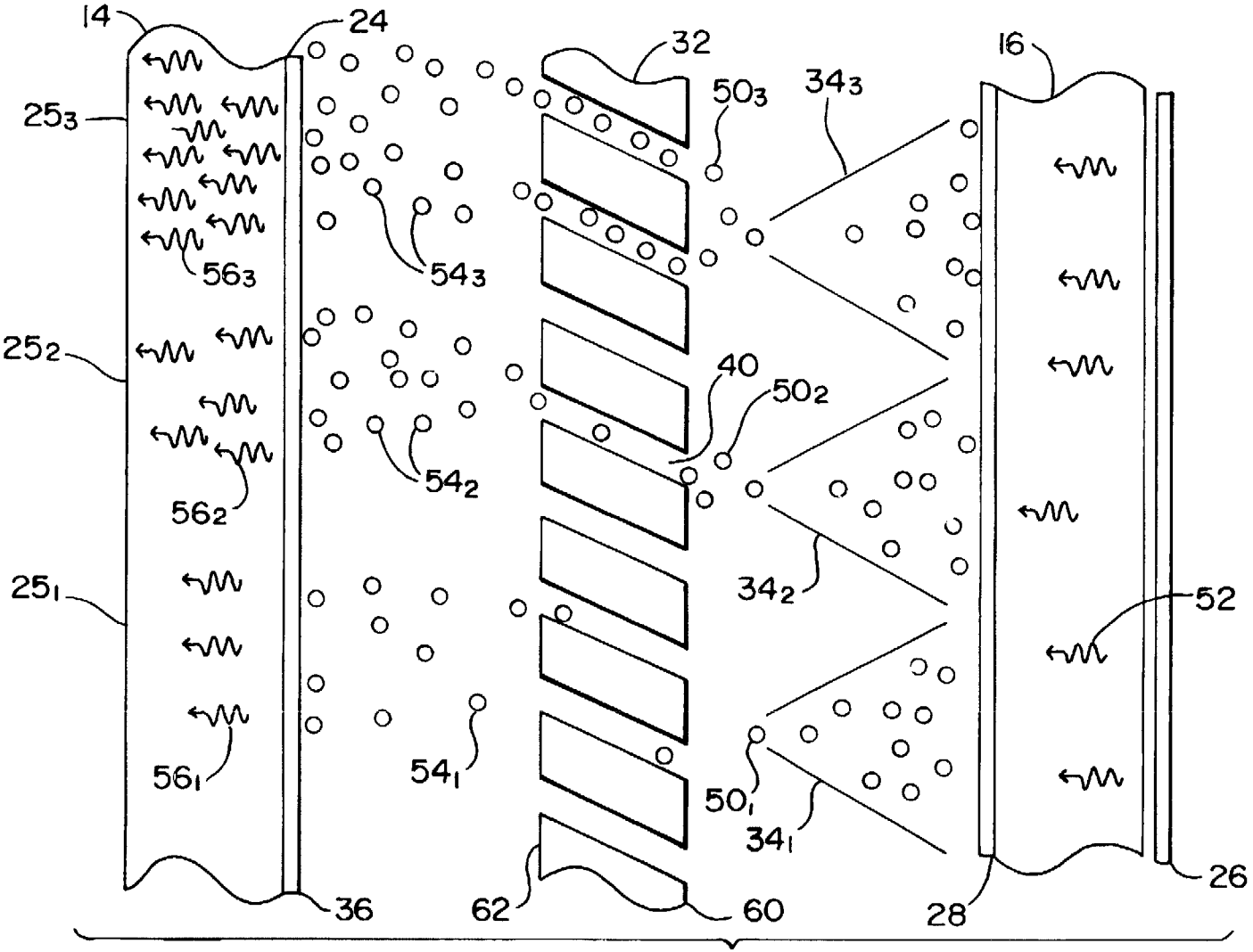
FIG. 4 is a cross sectional view of the invention along a horizontal axis illustrating, schematically, the operation of the invention.

The principle of operation of the invention is more fully elucidated with reference to FIG. 4. Photons 52, emanating in a diffuse and even flux from areal light source 26, are depicted as wavy arrows illuminating photocathodes 28 via input window 16. In response to illumination, photocathodes 28 emit electrons 50, depicted as circles. By virtue of a bias voltage of approximately 20 volts on input 60 of channel plate 32, as referenced to photocathodes 28, electrons 50 are accelerated toward input 60 of channel plate 32. The manner in which control grids $34_1$, $34_2$, and $34_3$ regulate the brightness of corresponding image pixel elements $25_1$, $25_2$, and $25_3$, is illustrated by successive reference to FIG. 4. Pixel element $25_1$ corresponds to the pair of photocathode 28 and control grids $34_1$. Control grid $34_1$ has been biased virtually to cutoff through application of a voltage close to −30 volts with respect to photocathode 28 such that only the odd electron $50_1$ is attracted from photocathode 28 to input 60 of channel plate 32. Only a few electrons $54_1$, constituting the dark current, flow, under conditions of cutoff bias, from output 62 of channel plate 32 to phosphor electrode 36. Similarly, the number of photons $56_1$ emitted by phosphor 24 is small, allowing substantial contrast between dark image pixel element $25_1$ and illuminating image pixel elements $25_2$, and $25_3$.

Control grid 342 has been biased for intermediate gain by application of a voltage less negative than the voltage applied to control grid $34_1$. Consequently, a higher number of electrons $50_2$ are attracted to input 60 of channel plate 32. Electrons 502 are multiplied inside pore 40 of channel plate 32 so that an amplified stream of electrons $54_2$ is accelerated toward phosphor electrode 36 and bombards phosphor 24 causing phosphor 24 to glow and emit photons $56_2$ at image pixel element $25_2$.

As a final example, control grid $34_3$ has been biased for high gain by application of a voltage substantially less negative than the voltage applied to control grid $34_1$. Consequently, a still higher number of electrons $50_3$ are attracted to input 60 of channel plate 32. Electrons $50_3$ are multiplied inside channel plate 32 to nearly saturation so that an amplified stream of electrons $54_3$ is accelerated toward phosphor electrode 36 and bombards phosphor 24 causing phosphor 24 to glow and emit photons $56_3$ at image pixel element $25_3$.

Figure 5:
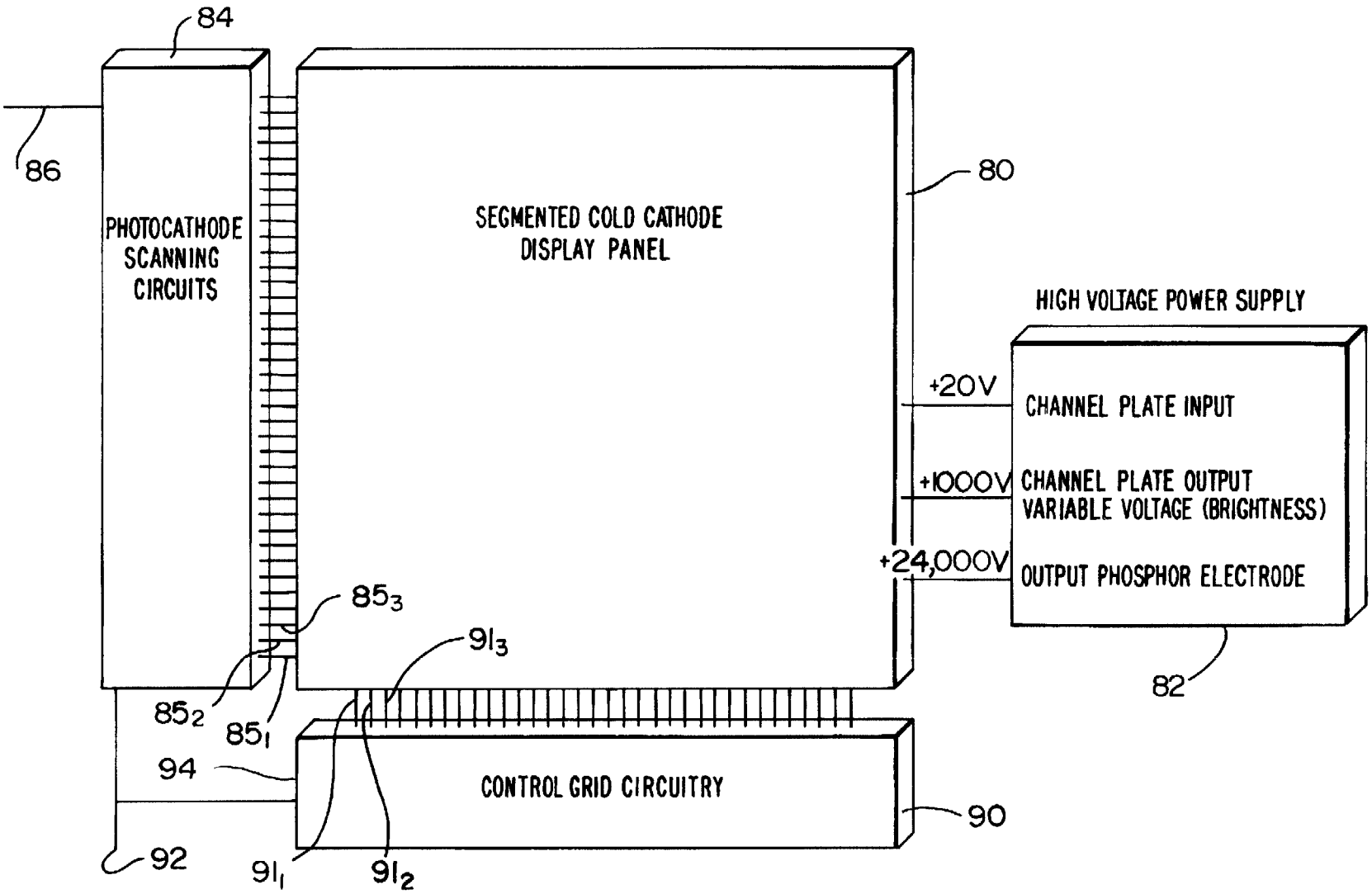
FIG. 5 illustrates a simplified block diagram of the control circuitry of the invention.

The method of displaying an image is now described with reference to the electronic block diagram of the control circuitry shown in FIG. 5. Fixed voltages are applied to segmented cold cathode display panel 80 by power supply 82. In particular, input 60 and output 62 of channel plate 32 (shown in FIG. 4) are biased, respectively, at voltages of approximately 20 volts and 1000 volts, where the potential is stated with respect to ground (not shown). Phosphor electrode 36 (shown in FIG. 4) is maintained at a potential of approximately 24,000 volts with respect to ground.

Photocathode scanning circuits 84 sequentially enable successive photocathodes 28, one at a time via connections $85_1$, $85_2$, $85_3$ . . . , by increasing the value of their negative bias with respect to the channel plate input voltage. Photocathodes 28 are enabled at the horizontal line rate. For a non-interlaced (60 frames/second, 525 photocathode segments) NTSC system, a single photocathode would be enabled for 31.75 microseconds every frame. This scanning process is synchronized to the video signal by means of both vertical sync input 86 and horizontal sync input 94.

In the preferred embodiment, control grid circuitry 90 is made up of a single line charge coupled device (not shown)

and a number of output stages (not shown) corresponding to the number of control grids 34. This allows video data received via video input 92 to be prepared, line by line, and converted to voltages which are applied, via connections $\mathbf{91}_1$, $\mathbf{91}_2$, $\mathbf{91}_3$ . . . , concurrently to control grids 34 corresponding to an entire photocathode 28. Horizontal sync input 94 maintains the synchronization of this process with the video signal.

In order to display a video image (not shown) in full color, a striped output phosphor 24 (shown in FIG. 4) is employed, such as the common Trinitron™ style phosphor. Control grid circuitry 90 is correspondingly adapted, through incorporation of three charged coupled devices (not shown) to provide control voltages to interleaved control grids 34, as would be apparent to one skilled in the art.

Obviously, many modifications and variations of the present invention are possible in light of the above teachings. It is therefore to be understood that within the scope of the appended claims the invention may be practiced otherwise than as specifically described.

I claim:

1. A display tube, comprising:

an evacuated envelope having a substantially flat output faceplate;

a rear wall substantially parallel to said output faceplate;

a plurality of electron emitters comprising a plurality of segmented photocathodes wherein said plurality of electron emitters are substantially parallel and interior to said rear wall;

at least one channel plate having a plurality of pores for multiplying said electrons;

at least one phosphor plate substantially parallel and interior to said output faceplate;

a plurality of control grids disposed in a plane parallel to said front and said rear walls and oriented in a direction orthogonal to said electron emitters; and an electronic control means for setting component voltages to create a display image in response to a video signal.

2. The display tube of claim 1 further including a porous conducting surface for providing an equipotential plane for said control grids.

3. The display tube of claim 1 further including an areal light source substantially parallel to said photocathode.

4. The display tube of claim 3, wherein said areal light source is an electro-luminescent panel.

5. The display tube of claim 1 wherein said rear wall is substantially transparent.

6. The display tube of claim 5, wherein said areal light source is exterior to said rear wall.

7. The display tube of claim 1, wherein said phosphor plate includes phosphors of a plurality of colors.

8. The display tube of claim 1, further including a supporting means for preventing implosion of said front and said rear walls of said evacuated envelope.

9. The display tube of claim 8, wherein said supporting means include structural partitions.

10. The display tube of claim 8, wherein said supporting means is substantially thin.

11. The display tube of claim 1, wherein said electronic control means include a single line charge coupled device with an output associated with each of said control grids.

* * * * *